US009111490B2

(12) United States Patent
Ra et al.

(10) Patent No.: US 9,111,490 B2
(45) Date of Patent: Aug. 18, 2015

(54) GATE DRIVING CIRCUIT AND ORGANIC ELECTROLUMINESCENT DISPLAY APPARATUS USING THE SAME

(75) Inventors: Dong-Gyun Ra, Yongin (KR); Woo-Chul Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 840 days.

(21) Appl. No.: 12/987,960

(22) Filed: Jan. 10, 2011

(65) Prior Publication Data

US 2011/0273408 A1 Nov. 10, 2011

(30) Foreign Application Priority Data

May 7, 2010 (KR) ..... 10-2010-0043055

(51) Int. Cl.
*G09G 3/32* (2006.01)

(52) U.S. Cl.
CPC ..... *G09G 3/3266* (2013.01); *G09G 2300/0814* (2013.01); *G09G 2310/0286* (2013.01)

(58) Field of Classification Search
CPC ..... G09G 2310/0286; G09G 3/3266
USPC ..... 345/204, 76, 82, 212, 214, 92, 169.3
See application file for complete search history.

(56) References Cited

U.S. PATENT DOCUMENTS 6,501,456 B1 12/2002 Saito et al.
7,268,766 B2 * 9/2007 Kim et al. ..... 345/102
2003/0128199 A1 * 7/2003 Kimura ..... 345/204
2006/0158394 A1 7/2006 Choi
2006/0221012 A1 10/2006 Ikeda
2006/0227095 A1 * 10/2006 Kim et al. ..... 345/100
2007/0079192 A1 * 4/2007 Kim et al. ..... 714/726
2007/0124633 A1 5/2007 Kim
2007/0240024 A1 10/2007 Shin
2007/0296682 A1 * 12/2007 Hwang ..... 345/100
2008/0246697 A1 10/2008 Kim
2009/0213056 A1 8/2009 Nam et al.

FOREIGN PATENT DOCUMENTS

JP 2005-134459 5/2005
JP 2005-202422 7/2005
JP 2006-047493 2/2006
JP 2006-184871 7/2006
JP 2006-284798 10/2006
JP 2008-257159 10/2008
KR 1999-018739 A 3/1999
KR 10-2000-0074656 A 12/2000

(Continued)

OTHER PUBLICATIONS

Korean Patent Abstracts, Publication No. 10-0492986, dated May 25, 2005, corresponding to KR 1999-018739 listed above.

(Continued)

*Primary Examiner* — Amare Mengistu
*Assistant Examiner* — Shawna Stepp Jones
(74) *Attorney, Agent, or Firm* — Christie, Parker & Hale, LLP

(57) ABSTRACT

A gate driving circuit generates a gate driving signal for a P-type transistor and a gate driving signal for an N-type transistor, a scanning signal and a light emission control signal, and the gate driving circuit provides a pulse width control function and a concurrent light emitting function.

14 Claims, 8 Drawing Sheets

(56) References Cited

FOREIGN PATENT DOCUMENTS

| | | | |
|---|---|---|---|
| KR | 10-2003-0021849 | A | 3/2003 |
| KR | 10-0602347 | B1 | 7/2006 |
| KR | 10-2007-0049906 | | 5/2007 |
| KR | 10-0748321 | B1 | 8/2007 |
| KR | 10-2009-0092644 | | 9/2009 |

OTHER PUBLICATIONS

Korean Registration Determination Certificate dated Nov. 18, 2011 issued by the KPO for corresponding Korean Patent Application No. 2010-0043055, 5 pages.
JPO Office action dated Dec. 2, 2014, for corresponding Japanese Patent application 2011-003998, (2 pages).

* cited by examiner

GATE DRIVING CIRCUIT AND ORGANIC ELECTROLUMINESCENT DISPLAY APPARATUS USING THE SAME

CROSS-REFERENCE TO RELATED PATENT APPLICATION

This application claims priority to and the benefit of Korean Patent Application No. 10-2010-0043055, filed on May 7, 2010, in the Korean Intellectual Property Office, the disclosure of which is incorporated herein in its entirety by reference.

BACKGROUND

1. Field

Aspects of embodiments according to the present invention relate to gate driving circuits and organic electroluminescent display apparatuses that include the gate driving circuits.

2. Description of the Related Art

A light-emitting display apparatus converts input data into an image and provides the image to a user, by applying data signals corresponding to the input data to a plurality of pixel circuits, thereby adjusting luminance of each pixel. The light-emitting display apparatus may be realized by using self-light-emitting devices, such as organic light emitting diodes (OLEDs). When each pixel includes a self-light-emitting device, a scanning signal for selecting a pixel for receiving the data signal, and a light emission control signal for controlling light emission of the self-light-emitting device are generated and output to each pixel.

SUMMARY

One or more embodiments of the present invention are directed toward gate driving circuits which not only generate a scanning signal and a light emission control signal for a light-emitting display apparatus, wherein a pixel circuit is realized by an N-type transistor, but also generate a scanning signal and a light emission control signal for a light-emitting display apparatus, wherein a pixel circuit is realized by a P-type transistor.

One or more embodiments of the present invention also provide gate driving circuits, wherein a scanning signal and a light emission control signal are generated and output together in one gate driving circuit.

One or more embodiments of the present invention also provide gate driving circuits, wherein pulse widths of gate driving signals, such as a scanning signal and a light emission control signal, are adjustable.

One or more embodiments of the present invention also provide gate driving circuits which generate a light emission control signal that concurrently emits pixels of a light-emitting display apparatus.

According to an embodiment of the present invention, there is provided a gate driving circuit for driving a light-emitting display apparatus. The gate driving circuit includes: a first shift register for outputting a first shift register output in response to a first frame start pulse; a second shift register for outputting a second shift register output in response to a second frame start pulse; a first inverter for selectively inverting the first shift register output according to a first inversion control signal; and a second inverter for selectively inverting the second shift register output according to a second inversion control signal, wherein the first shift register and the second shift register independently operate, and the first inverter and the second inverter independently operate, and a first group gate driving signal is output through the first shift register and the first inverter, and a second group gate driving signal is output through the second shift register and the second inverter.

The gate driving circuit may further include: a level shifter for adjusting voltage levels of an output of the first inverter and an output of the second inverter; and an output buffer for storing an output of the level shifter and outputting the output of the level shifter as the first and second group gate driving signals.

The first shift register may be configured to operate in response to at least one first shift register clock signal, and the second shift register may be configured to operate in response to at least one second shift register clock signal.

The first shift register may be configured to adjust a pulse width of the first group gate driving signal in response to a first pulse width control signal, and the second shift register may be configured to adjust a pulse width of the second group gate driving signal in response to a second pulse width control signal. The first shift register may be configured to operate in response to at least one first shift register clock signal, the second shift register may be configured to operate in response to at least one second shift register clock signal, the first shift register may be configured to operate in synchronization with a level of the at least one first shift register clock signal, or operate to latch at a rising or falling edge of the at least one first shift register clock signal, while the first frame start pulse is activated, according to the first pulse width control signal, and the second shift register may be configured to operate in synchronization with a level of at least one second shift register clock signal, or operate to latch at a rising or falling edge of the at least one second shift register clock signal, while the second frame start pulse is activated, according to the second pulse width control signal.

When a pulse width of the first group gate driving signal is adjusted, the first pulse width control signal may be activated and the pulse width of the first group gate driving signal may be determined by a pulse width of the first frame start pulse, and when a pulse width of the second group gate driving signal is adjusted, the second pulse width control signal may be activated and the pulse width of the second group gate driving signal may be determined by a pulse width of the second frame start pulse.

The gate driving circuit may be configured to select a number or combination of output channels to be activated from among output channels of the first and second group gate driving signals, according to an output channel selection signal.

The gate driving circuit may be configured to control an output order of output channels of the first and second group gate driving signals, according to a scanning direction control signal.

The gate driving circuit may be configured to sequentially or simultaneously output the first and second group gate driving signals, according to a simultaneous light emission control signal.

When the first or second group gate driving signal is a signal supplied to a pixel circuit realized with a P-type transistor, the corresponding first or second inversion control signal may be activated, and the corresponding first or second shift register output may be inverted and output from the corresponding first or second inverter.

When the first or second group gate driving signal is a signal supplied to a pixel circuit realized with an N-type transistor, the corresponding first or second inversion control signal may be deactivated, and the corresponding first or second shift register output may be transmitted as an output from the corresponding first or second inverter.

Also, the first group gate driving signal may be a scanning signal or a light emission control signal, and the second group gate driving signal may be a scanning signal or a light emission control signal. In other words, the first and second group gate driving signals may be different types of gate driving signals, for example, the first group gate driving signal may be a scanning signal and the second group gate driving signal may be a light emission control signal.

The light-emitting display apparatus may be an organic electroluminescent display apparatus.

According to another embodiment of the present invention, there is provided a gate driving circuit for driving an organic electroluminescent display apparatus. The gate driving circuit outputs gate driving signals divided into a plurality of groups and independently drives the plurality of groups. The gate driving circuit is adapted to generate a gate driving signal for a P-type transistor and a gate driving signal for an N-type transistor, and to independently generate and output a scanning signal and a light emission control signal to a scanning signal group and a light emission control signal group, respectively, of the plurality of groups of gate driving signals.

Circuits for the plurality of groups of gate driving signals, respectively, may be independently configured and may be driven by a separate control signal.

Pulse widths of the gate driving signals may be adjusted by a pulse width control signal and a frame start pulse.

The gate driving signals of the plurality of groups of gate driving signals may be concurrently output in accordance with a simultaneous light emission control signal.

According to another aspect of the present invention, there is provided an organic electroluminescent display apparatus including: a plurality of pixels located at crossing regions of data lines and scanning lines, each of the pixels including an organic light-emitting diode (OLED); a gate driver for outputting scanning signals through the scanning lines to each of the plurality of pixels, and outputting a light emission control signal through light emission control lines; and a data driver for generating a data signal corresponding to an image and outputting the generated data signal to each of the plurality of pixels through the data lines, wherein the gate driver includes the gate driving circuit above.

BRIEF DESCRIPTION OF THE DRAWINGS

The above and other features and aspects of the present invention will become more apparent by describing in detail exemplary embodiments thereof with reference to the attached drawings in which.

DETAILED DESCRIPTION

Hereinafter, the present invention will be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art.

Unless defined otherwise, terms used herein have the same meaning as is commonly understood by one of ordinary skill in the art to which this invention belongs.

Also, while describing the present invention, detailed descriptions about related well-known functions or configurations may be omitted.

Figure 1:
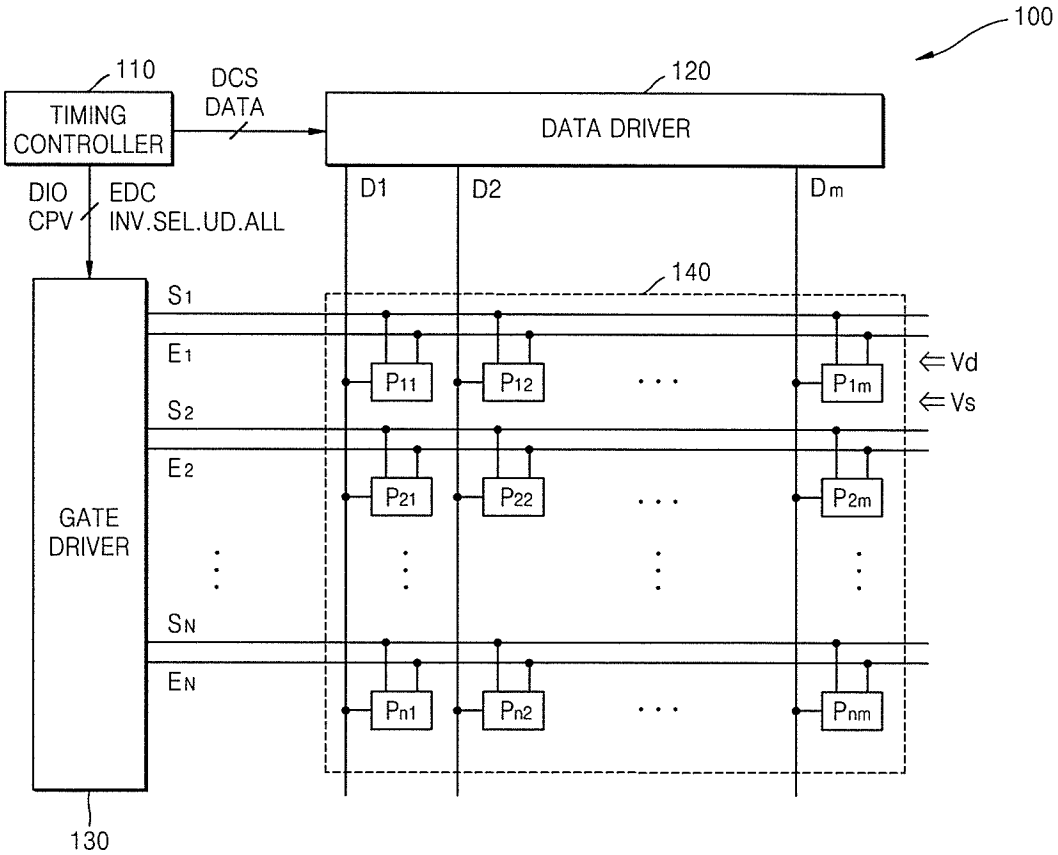
FIG. 1 is a block diagram illustrating a light-emitting display apparatus according to an embodiment of the present invention.

FIG. 1 is a block diagram illustrating a light-emitting display apparatus 100 according to an embodiment of the present invention.

Referring to FIG. 1, the light-emitting display apparatus 100 according to an embodiment of the present invention includes a timing controller 110 for controlling a data driver 120 and a gate driver 130, the data driver 120 for outputting a data signal corresponding to an input image to each of a plurality of pixels $P_{11}$ through $P_{nm}$ respectively through data lines $D_1$ through $D_m$ the gate driver 130 for outputting a scanning signal to the plurality of pixels $P_{11}$ through $P_{nm}$ respectively through scanning lines $S_1$ through $S_n$ and outputting a light emission control signal through light emission control lines $E_1$ through $E_n$ and a display unit 140 including the pixels $P_{11}$ through $P_{nm}$ respectively connected to the scanning lines $S_1$ through $S_n$ the light emission control lines $E_1$ through $E_n$ and the data lines $D_1$ through $D_m$.

The display unit 140 includes the pixels $P_{11}$ through $P_{nm}$ at crossing regions of the scanning lines $S_1$ through $S_n$ the light emission control lines $E_1$ through $E_n$ and the data lines $D_1$ through $D_m$. As shown in FIG. 1, the pixels $P_{11}$ through $P_{nm}$ may be arranged in an m×n matrix form. The pixels $P_{11}$ through $P_{nm}$ each include a light-emitting device, and receive a first voltage Vd and a second voltage Vs, which may be externally provided, for the light-emitting device to emit light. Also, each of the pixels $P_{11}$ through $P_{nm}$ supplies a driving current or voltage to the light-emitting device so that the light-emitting device emits light with luminance corresponding to the data signal. The light-emitting device may differ according to the type of the light-emitting display apparatus 100. In one embodiment, the light-emitting display apparatus 100 may be an organic electroluminescent display apparatus and the light-emitting device may be an organic light-emitting diode (OLED).

Each of the pixels $P_{11}$ through $P_{nm}$ controls an amount of current supplied to the OLED according to the data signal transmitted through the data lines $D_1$ through $D_m$. The OLED emits light having luminance corresponding to the data signal according to the light emission control signal transmitted through the light emission 15, control lines $E_1$ through $E_n$.

The timing controller 110 generates and outputs RGB data Data, a data driver control signal DCS, etc., to the data driver 120, and generates and outputs gate driver control signals DIO1, DIO2, CPV1 through CPV4, EDC1, EDC2, SEL, UD, ALL, INV1, and INV2 to the gate driver 130. The gate driver control signals DIO1, DIO2, CPV1 through CPV4, EDC1, EDC2, SEL, UD, ALL, INV1, and INV2 are signals for controlling a gate driving circuit 200 of FIG. 2 according to an embodiment of the present invention, and are described below in more detail.

The data driver 120 generates a data signal from the RGB data Data, and outputs the data signal to the pixels $P_{11}$ through $P_{nm}$ respectively through the data lines $D_1$ through $D_m$. The data driver 120 may generate the data signal from the RGB data Data by using a gamma filter, a digital-analog converter circuit, or the like. The data signal may be output to pixels in the same line for one horizontal period. Also, each of the plurality of the data lines $D_1$ through $D_m$ for transmitting the data signal may be connected to a plurality of pixels at the same column.

The gate driver 130 generates the scanning signal and the light emission control signal from the gate driver control signals DIO1, DIO2, CPV1 through CPV4, EDC1, EDC2, SEL, UD, ALL, INV1, and INV2, and outputs the scanning signal and the light emission control signal to each of the pixels $P_{11}$ through $P_{nm}$ through the scanning lines $S_1$ through $S_n$ and the light emission control lines $E_1$ through $E_n$. Each of the scanning lines $S_1$ through $S_n$ and each of the light emission control lines $E_1$ through $E_n$ may be connected to a plurality of pixels at the same row. The scanning signals and the light emission control signals may be sequentially or concurrently (e.g., simultaneously) output line-by-line, respectively from the scanning lines $S_1$ through $S_n$ and the light emission control lines $E_1$ through $E_n$. According to an embodiment of the light-emitting display apparatus 100, the gate driver 130 may generate and output an additional driving signal to each of the pixels $P_{11}$ through $P_{nm}$.

Since a conventional gate driving circuit included in the gate driver 130 drives a thin film transistor (TFT) of a liquid crystal display (LCD), an output of a conventional gate driver typically drives a gate terminal of an NMOS TFT of an LCD. Also, outputs of each channel of the conventional gate driver are synchronized with a clock signal, and are sequentially output from a top channel to a bottom channel or from a bottom channel to a top channel while maintaining the same pulse width.

However, in an organic electroluminescent display apparatus, a pixel circuit of the pixels $P_{11}$ through $P_{nm}$ is not only realized with NMOS transistors, but also with PMOS transistors according to an embodiment of the present invention. Thus, the conventional gate driver for the LCD is not suitable for driving the organic electroluminescent display apparatus including a pixel circuit realized with P-type transistors only.

Also, in one embodiment, in order to drive the organic electroluminescent display apparatus, a light emission control signal may be provided for controlling the OLED to emit light, aside from a scanning signal for reading a data signal. Moreover, a light emitting time of an OLED may be controlled by adjusting a pulse width of a light emission control signal to extend a lifetime of the OLED.

Further, in one embodiment, OLEDs of the organic electroluminescent display apparatus may concurrently (e.g., simultaneously) emit light by outputting a light emission control signal from all channels of the gate driver 130.

However, a conventional gate driving circuit used in an LCD does not have such a technology described above.

One or more embodiments of the present invention disclose a gate driving circuit capable of performing the above-described functions to drive a light-emitting display apparatus including a self-light-emitting device, such as an organic electroluminescent display apparatus.

Figure 2:
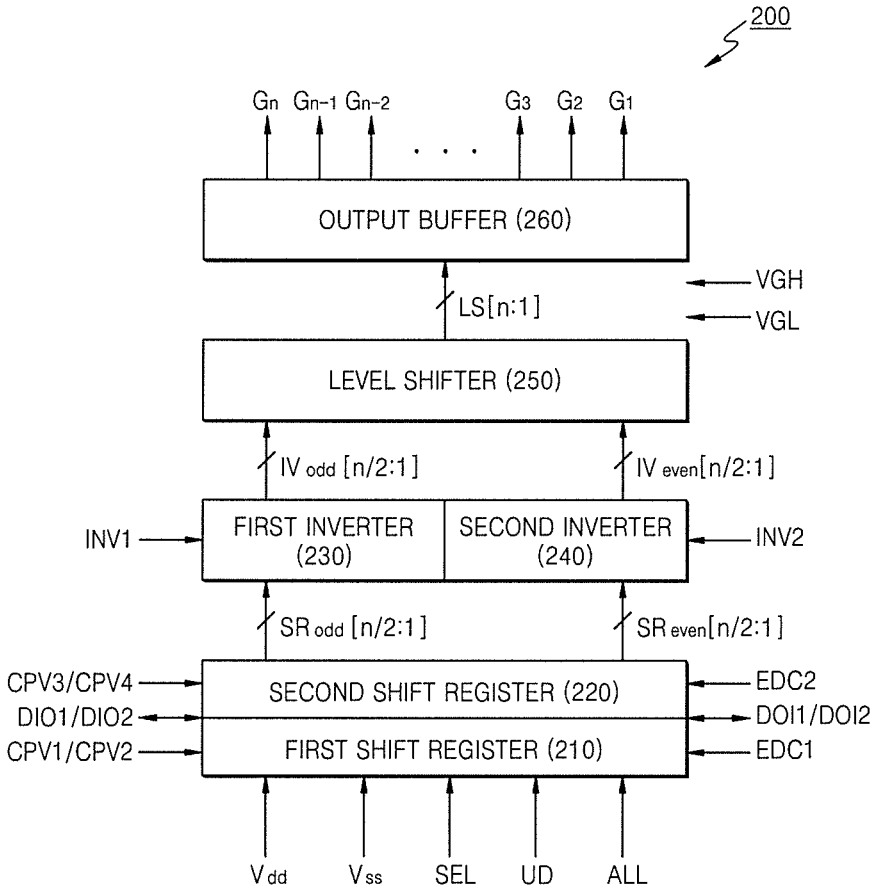
FIG. 2 is a block diagram illustrating a gate driving circuit according to an embodiment of the present invention.

FIG. 2 is a block diagram illustrating the gate driving circuit 200 according to an embodiment of the present invention.

The gate driver 130 of FIG. 1 according to an embodiment of the present invention includes at least one gate driving circuit 200. The gate driving circuit 200 according to one embodiment of the present invention may perform the following functions:

- function of generating a driving signal for driving a P-type transistor and a driving signal for driving an N-type transistor;
- function of selectively outputting a scanning signal and a light emission control signal;
- function of adjusting a pulse width of a gate driving signal (emission duty control) and outputting the gate driving signal; and
- function of concurrently (e.g., simultaneously) outputting gate driving signals from all output channels of a gate driving circuit.

The gate driving circuit 200 according to one embodiment of the present invention includes a first shift register 210, a second shift register 220, a first inverter 230, a second inverter 240, a level shifter 250, and an output buffer 260.

The gate driving circuit 200 performs the above functions by receiving the gate driver control signals DIO1, DIO2, CPV1 through CPV4, EDC1, EDC2, SEL, UD, ALL, INV1, and INV2 from the timing controller 110. The timing controller 110 may adjust and output the gate driver control signals DIO1, DIO2, CPV1 through CPV4, EDC1, EDC2, SEL, UD, ALL, INV1, and INV2 so that the gate driving circuit 200 performs a certain function.

Also, the gate driving circuit 200 may output gate driving signals in a plurality of groups. For example, output channels of the gate driving circuit 200 may be divided into odd channels and even channels to be independently driven. Hereinafter, an example of the gate driving circuit 200 independently driving first group gate driving signals G1, G3, . . . , Gn−1 and second group gate driving signals G2, G4, . . . , Gn will be described. The first group gate driving signals G1, G3, . . . , Gn−1 are output through the first shift register 210, the first inverter 230, the level shifter 250, and the output buffer 260. The second group gate driving signals G2, G4, . . . , Gn are output through the second shift register 220, the second inverter 240, the level shifter 250, and the output buffer 260.

The first shift register 210 and the second shift register 220 operate independently so as to independently drive the first group gate driving signals G1, G3, . . . , Gn−1 and the second group gate driving signals G2, G4, . . . , Gn.

The first shift register 210 includes a first frame start pulse input terminal DIO1, and a first frame start pulse output terminal DOI1. The second shift register 220 includes a second frame start pulse input terminal DIO2, and a second frame start pulse output terminal DOI2. Also, the first shift register 210 includes at least one first shift register clock terminal, and the second shift register 220 includes at least one second shift register clock terminal. Accordingly, the first and second shift registers 210 and 220 independently operate according to separate frame start pulses and clock signals. According to one embodiment of the present invention, first and second clock signals CPV1 and CPV2 are input to the first shift register clock terminal of the first shift register 210, and third and fourth clock signals CPV3 and CPV4 are input to the second shift register clock terminal of the second shifter register 220. A number of clock signals input to the first and second shift registers 210 and 220 may differ according to other embodiments.

According to one embodiment of the present invention, frame start pulses are independently applied to the first and second shift registers 210 and 220, and thus points of time when the first and second frame start pulse input terminals DIO1 and 0102 are activated and pulse widths of the frame start pulses may be independently controlled.

Also, since clock signals are independently applied to the first and second shift registers 210 and 220, timings, e.g., pulse widths and phases of the clock signals, of the first and second shift registers 210 and 220 may be independently controlled. Accordingly, the first group gate driving signals G1, G3, . . . , Gn−1 and the second group gate driving signals G2, G4, . . . , Gn may be driven to overlap each other or to have a phase difference. Also, a plurality of clock signals may be applied to each of the first and second shift registers 210 and 220, and accordingly, the gate driving signals in one group, for example, the first group gate driving signals G1, G3, . . . , Gn−1 may be driven to overlap each other or to have a phase difference.

Also, by independently controlling the clock signals and the frame start pulses of the first and second shift registers 210 and 220, each of the first and second shift registers 210 and 220 may be driven to generate different types of gate driving signals, for example, a scanning signal and a light emission control signal.

The first shift register 210 generates and outputs first shift register outputs $SR_{odd}$[n/2:1] to the first inverter 230, according to the first frame start pulse and the first and second clock signals CPV1 and CPV2. The second shift register 220 generates and outputs second shift register outputs $SR_{even}$[n/2:1] to the second inverter 240, according to the second frame start pulse and the third and fourth clock signals CPV3 and CPV4.

The first inverter 230 and the second inverter 240 independently operate in response to a first inversion control signal INV1 and a second inversion control signal INV2, respectively. When the first inversion control signal INV1 is activated, the first inverter 230 inverts and outputs the inverted first shift register outputs $SR_{odd}$[n/2:1] to the level shifter 250, and when the first inversion control signal INV1 is deactivated, the first inverter 230 transmits the first shift register outputs $SR_{odd}$[n/2:1] without inversion to the level shifter 250. When the second inversion control signal INV2 is activated, the second inverter 240 inverts and outputs the inverted second shift register outputs $SR_{even}$[n/2:1] to the level shifter 250, and when the second inversion control signal INV2 is deactivated, the second inverter 240 transmits the second shift register outputs $SR_{even}$[n/2:1] without inversion to the level shifter 250.

The level shifter 250 adjusts voltage levels of input signals $IV_{odd}$[n/2:1] and $IV_{even}$[n/2:1] respectively output from the first and second inverters 230 and 240 according to a gate-on voltage VGH and a gate-off voltage VGL, and transmits the adjusted input signals $IV_{odd}$[n/2:1] and $IV_{even}$[n/2:1] to the output buffer 260.

The output buffer 260 temporarily stores input signals LS[n:1] output from the level shifter 250, and outputs the input signals LS[n:1] as the first and second group gate driving signals G1 through Gn via gate driving signal output channels. According to an embodiment of the present invention, the first and second group gate driving signals G1 through Gn may be output to the scanning lines $S_1$ through $S_n$ or the light emission control lines $E_1$ through $E_n$ connected to the display unit 140.

Figure 3:
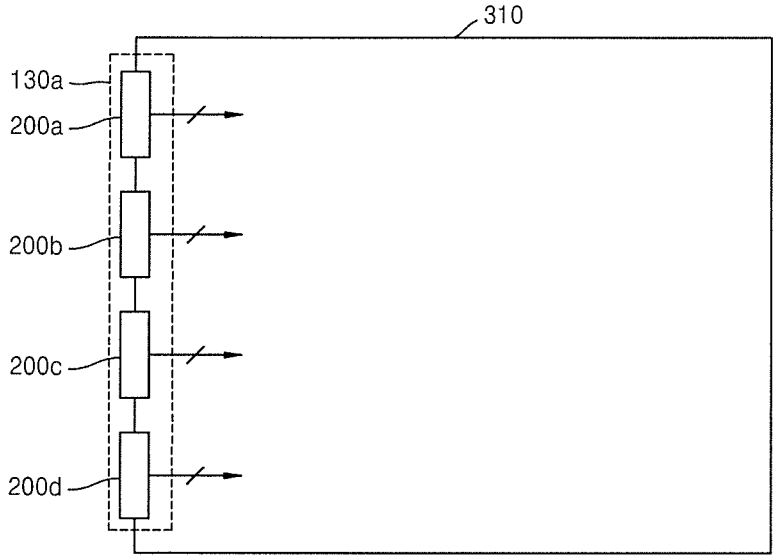
FIG. 3 is a diagram illustrating a gate driver including gate driving circuits, according to an embodiment of the present invention.

An output channel selection signal SEL determines a number or combination of output channels to be activated in the gate driving circuit 200. FIG. 3 is a diagram illustrating a gate driver 130*a* including gate driving circuits 200*a* through 200*d* according to an embodiment of the present invention. As shown in FIG. 3, the gate driver 130*a* includes the gate driving circuits 200*a* through 200*d* located at one side of a panel 310. Each of the gate driving circuits 200*a* through 200*d* may drive one or more sections of the plurality of scanning lines $S_1$ through $S_n$ and/or the plurality of light emission control lines $E_1$ through $E_n$ divided into sections. Also, a number of output channels of the gate driving circuits 200*a* through 200*d* may be determined according to the resolution of the light-emitting display apparatus 100. However, when the gate driving circuits 200*a* through 200*d* are arranged in the gate driver 130*a* according to the resolution of the light-emitting display apparatus 100, the gate driving circuit 200 may have one or more output channels in surplus, and in this case, some output channels are deactivated. Accordingly, the output channel selection signal SEL determines the number or combination of output channels to be activated in the gate driving circuit 200. The output channel selection signal SEL includes a plurality of bits, and thus may variously determine the number or combination of output channels.

Figure 4:
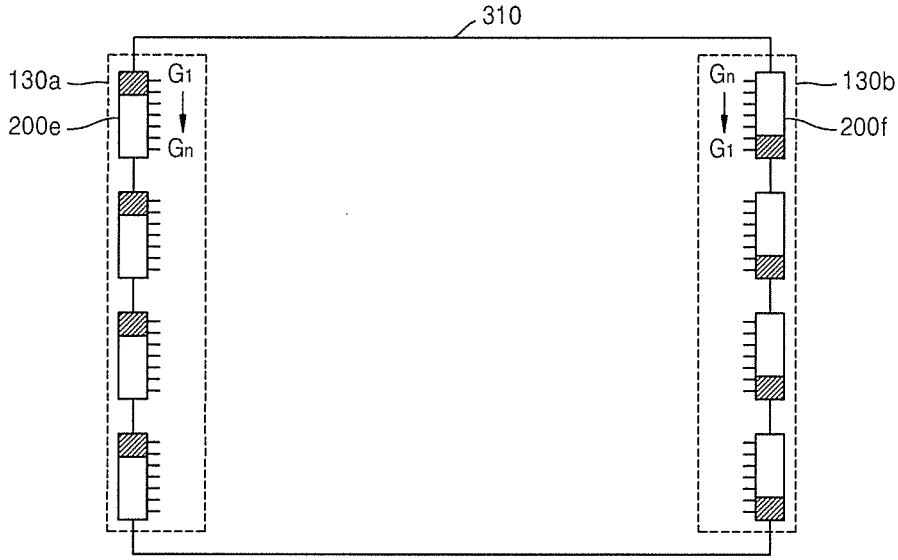
FIG. 4 is a diagram illustrating gate drivers respectively including gate driving circuits, according to other embodiments of the present invention.

A scanning direction control signal UD controls an order of outputting gate driving signals from the output channels of the gate driving circuit 200. FIG. 4 is a diagram illustrating gate drivers 130*a* and 130*b* respectively including gate driving circuits 200*e* and 200*f* according to other embodiments of the present invention. As shown in FIG. 4, the gate driving circuits 200*e* and 200*f* are not located at one side of the panel 310 but on both sides of the panel 310. When the light-emitting display apparatus 100 having a large size is driven, lengths of the scanning lines $S_1$ through $S_n$ and the light emission control lines $E_1$ through $E_n$ driven by the gate driving circuit 200 are increased, and thus a load is increased and a horizontal period is lengthened. Accordingly, a pixel that is distanced from the gate driving circuit 200 may receive a distorted driving signal, thereby deteriorating the quality of a displayed image. Thus, as shown in FIG. 4, the gate driving circuits 200*e* and 200*f* are located at respective sides of the panel 310, and may be driven in synchronization. Here, in the gate driving circuit 200*e* included in the gate driver 130*a* located at the left side of the panel 310, gate driving signals are sequentially output from an output channel of the first gate driving signal G1 to an output channel of the $n^{th}$ gate driving signal Gn, whereas in the gate driving circuit 200*f* included in the gate driver 130*b* located at the right side of the panel 310, the gate driving signals are sequentially output from an output channel of the $n^{th}$ gate driving signal Gn to an output channel of the first gate driving signal G1. In other words, scanning directions of the gate driving circuits 200*e* located at the left side of the panel 310 and the gate driving circuits 200*f* located at the right side of the panel 310 are different. The scanning direction control signal UD is used to control the scanning directions of the gate driving circuits 200*e* and 200*f*. The scanning direction may be determined based on a level of the scanning direction control signal UD. For example, when the scanning direction control signal UD is at a high level, the gate driving signals are sequentially output from the output channel of the first gate driving signal G1 to the output channel of the $n^{th}$ gate driving signal Gn, and when the scanning direction control signal UD is at a low level, the gate driving signals are sequentially output from the output channel of the $n^{th}$ gate driving signal Gn to the output channel of the first gate driving signal G1.

Also, a first power supply voltage $V_{dd}$ and a second power supply voltage $V_{ss}$ which operate as power supply voltages, are supplied to the gate driving circuits 200*e* and 200*f*.

The above-described functions of the gate driving circuit 200 according to one embodiment of the present invention will now be described in more detail.

First, the function of respectively generating a driving signal for driving the P-type transistor and a driving signal for driving the N-type transistor will be described.

Figure 5:
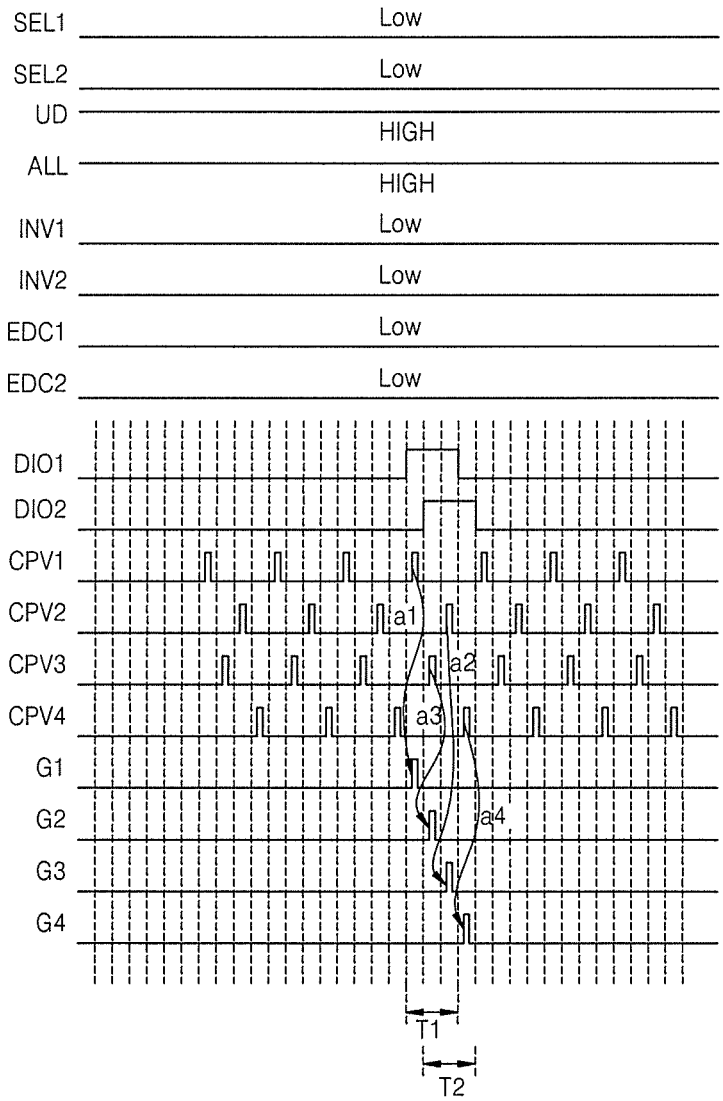
FIG. 5 is a timing diagram for describing an operation for generating a driving signal for driving an N-type transistor.

FIG. 5 is a timing diagram for describing an operation for generating the driving signal for driving the N-type transistor. Timing diagrams of FIGS. 5 through 10 only illustrate two gate driving signals of the first group gate driving signals G1, G3, . . . , Gn−1 and two gate driving signals of the second group gate driving signals G2, G4, . . . , Gn, namely, the first group gate driving signals G1 and G3 and the second group gate driving signals G2 and G4 for the convenience of description. The two first group gate driving signals G1 and G3 and the two second group gate driving signals G2 and G4 are also referred to as the first gate driving signal G1, the second gate driving signal G2, the third gate driving signal G3, and the fourth gate driving signal G4.

The gate driving circuit 200 according to one embodiment of the present invention may generate the gate driving signals G1 through Gn for the N-type transistor. In other words, when the driving signal for the N-type transistor is generated, the first and second inverters 230 and 240 respectively transmit the first and second shift register outputs $SIR_{odd}$[n/2:1] and $SR_{even}$[n/2:1] without inversion, and when the driving signal for the P-type transistor is generated, the first and second inverters 230 and 240 respectively output the first and second shift register outputs $SR_{odd}$[n/2:1] and $SR_{even}$[n/2:1] after inversion. Alternatively, the gate driving circuit 200 may be realized so as to generate the driving signal for the P-type transistor when the outputs of the first and second shift registers 210 and 220 are not inverted. An embodiment of the gate driving circuit 200 for generating the gate driving signals G1 through Gn for the N-type transistor when the outputs of the first and second shift registers 210 and 220 are not inverted will now be described in more detail.

When the first and second group gate driving signals G1 through Gn are the driving signals for driving the N-type transistor, the first inversion control signal INV1 and the second inversion control signal INV2 are deactivated, and the first and second shift register outputs $SR_{odd}$[n/2:1] and $SR_{even}$[n/2:1] are output through the first inverter 230 and the second inverter 240, respectively, the level shifter 250, and the output buffer 260 without inversion. As shown in FIG. 5, in order to generate the driving signal for driving the N-type transistor, the first and second inversion control signals INV1 and INV2 are deactivated to, e.g., low levels, and the driving signals for driving the N-type transistor are output through the output channels of the first through fourth gate driving signals G1 through G4. The first through fourth gate driving signals G1 through G4 are output to corresponding scanning lines, for example, the scanning lines $S_1$ through $S_4$.

An exemplary operation will now be described with reference to FIG. 5. During a period T1, when the first frame start pulse is activated, the first gate driving signal G1 is activated to a high level in response to a pulse of the first clock signal CPV1 in operation a1, and the third gate driving signal G3 is activated to a high level in response to a pulse of the second clock signal CPV2 in operation a2. During a period T2, when the second frame start pulse is activated, the second gate driving signal G2 is activated to a high level in response to a pulse of the third clock signal CPV3 in operation a3, and the fourth gate driving signal G4 is activated to a high level in response to a pulse of the fourth clock signal CPV4 in operation a4. Also, since a function of selecting an output channel is not activated, the output channel selection signals SEL1 and SEL2 are deactivated to, e.g., low levels, the scanning direction control signal UD is set in, e.g., a high level corresponding to a first direction, and a function of controlling concurrent (e.g., simultaneous) light emission is deactivated and thus a simultaneous light emission control signal ALL is deactivated to, e.g., a high level. A function of controlling a pulse width is deactivated, and thus first and second pulse width control signals EDC1 and EDC2 are deactivated to, e.g., low levels.

Figure 6:
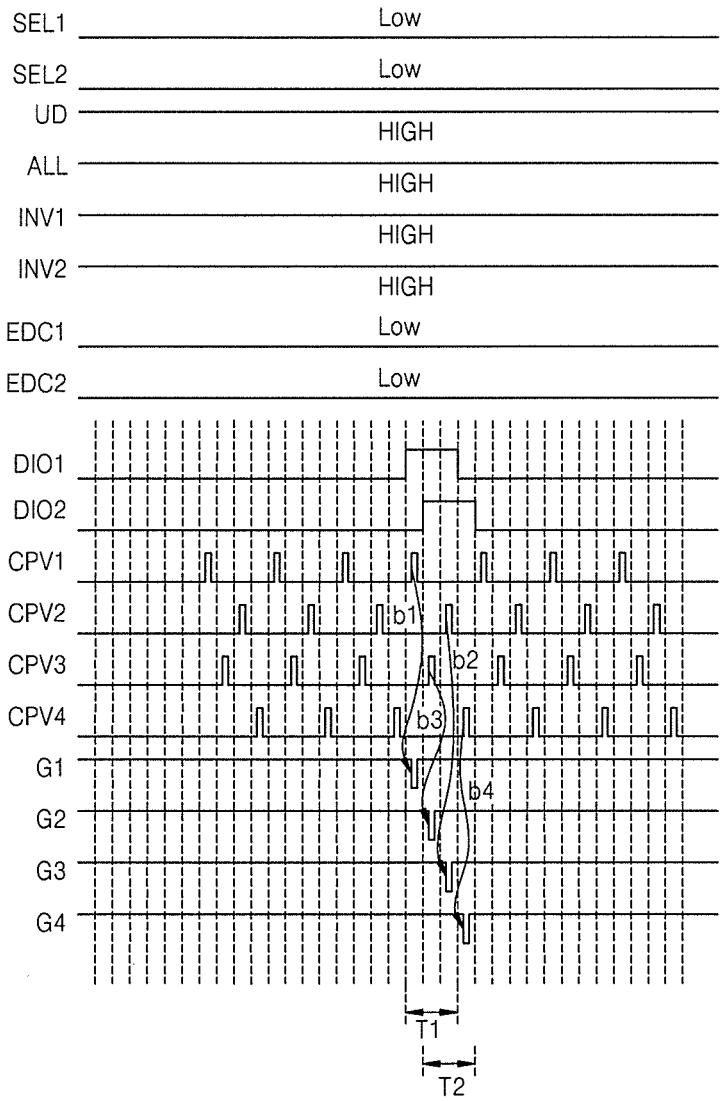
FIG. 6 is a timing diagram for describing an operation for generating a driving signal for driving a P-type transistor.

FIG. 6 is a timing diagram for describing an operation for generating the driving signal for driving the P-type transistor.

When the first and second group gate driving signals G1 through Gn are driving signals for driving the P-type transistor, the first inversion control signal INV1 and the second inversion control signal INV2 are activated so that the first and second shift register outputs $SR_{odd}$[n/2:1] and $SR_{even}$[n/2:1] are inverted respectively by the first and second inverters 230 and 240, and are output through the level shifter 250 and the output buffer 260. As shown in FIG. 6, in order to generate the driving signal for driving the P-type transistor, the first and second inversion control signals INV1 and INV2 are activated to, e.g., high levels, and the driving signals for driving the P-type transistor are output through the output channels of the first through fourth gate driving signals G1 through G4. The first through fourth gate driving signals G1 through G4 may be output to corresponding scanning lines, for example, the scanning lines $S_1$ through $S_4$.

An exemplary operation will now be described with reference to FIG. 6. During a period T1, when the first frame start pulse is activated, the first gate driving signal G1 is activated to a low level in response to the pulse of the first clock signal CPV1 in operation b1, and the third gate driving signal G3 is activated to a low level in response to the pulse of the second clock signal CPV2 in operation b2. During a period T2, when the second frame start pulse is activated, the second gate driving signal G2 is activated to a low level in response to the pulse of the third clock signal CPV3 in operation b3, and the fourth gate driving signal G4 is activated to a low level in response to the pulse of the fourth clock signal CPV4 in operation b4. Also, since a function of selecting an output channel is not activated, the output channel selection signals SEL1 and SEL2 are deactivated to, e.g., low levels, the scanning direction control signal UD is set in, e.g., a high level corresponding to a first direction, and a function of controlling concurrent (e.g., simultaneous) light emission is deactivated and thus the simultaneous light emission control signal ALL is deactivated to, e.g., a high level. A function of controlling a pulse width is deactivated, and thus the first and second pulse width control signals EDC1 and EDC2 are deactivated to, e.g., low levels.

The function of selectively outputting a scanning signal and a light emission control signal, and a function of adjusting a pulse width of a gate driving signal and outputting the gate driving signal will now be described in more detail.

In the gate driving circuit 200 according to one embodiment of the present invention, the first group gate driving signals G1, G3, . . . , Gn−1 may be used as scanning signals and the second group gate driving signals G2, G4, . . . , Gn may be used as light emission control signals. Since the first and second shift registers 210 and 220 are designed to independently operate, the first through fourth clock signals CPV1 through CPV4, the first and second frame start pulses, and the first and second pulse width control signals EDC1 and EDC2 input to the first and second shift registers 210 and 220 are each adjusted, so that one of the first and second shift registers 210 and 220 generates a scanning signal and the other generates a light emission control signal. The first and second inversion control signals INV1 and INV2 respectively input to the first and second inverters 230 and 240 may be controlled to generate the scanning signal or the light emission control signal.

Figure 7:
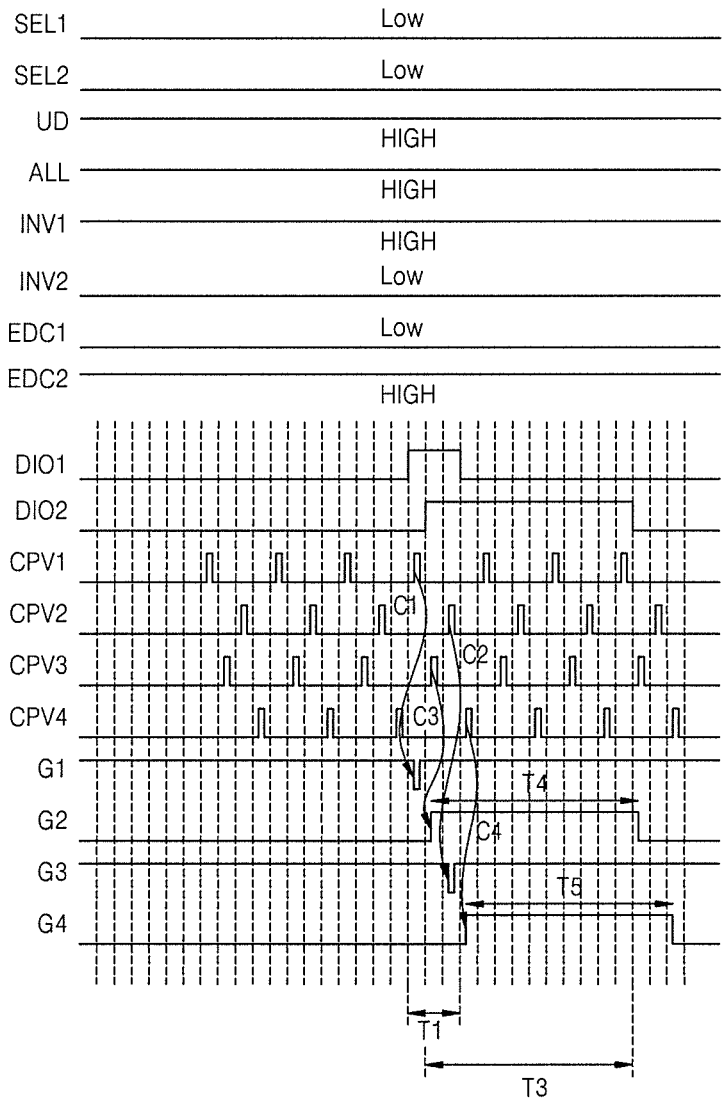
FIG. 7 is a timing diagram for describing an operation for independently generating and outputting a scanning signal and a light emission control signal, according to an embodiment of the present invention.

FIG. 7 is a timing diagram for describing an operation for independently generating and outputting a scanning signal and a light emission control signal, according to an embodiment of the present invention. In FIG. 7, the first group gate driving signals G1 and G3 are used as scanning signals for the P-type transistor, and the second group gate driving signals G2 and G4 are used as light emission control signals for the P-type transistor.

During a period T1 when the first frame start pulse is activated to a high level, the first gate driving signal G1 is activated to a low level in response to the pulse of the first clock signal CPV1 in operation C1, and the third gate driving signal G3 is activated to a low level in response to the pulse of the second clock signal CPV2 in operation C2. Since the first group gate driving signals G1 and G3 are used as the scanning signals for the P-type transistor, the first inversion control signal INV1 is activated to, e.g., a high level. Also, since the function of adjusting the pulse width is not used in the embodiment of FIG. 7 while operating a scanning signal, the first pulse width control signal EDC1 is deactivated to, e.g., a low level.

The second shift register 220 receives the activated second pulse width control signal EDC2, thereby operating as an edge-triggered latch for latching a rising or falling edge of the third and fourth clock signals CPV3 and CPV4. A level-triggered latch operation and an edge-triggered latch operation will now be described with reference to FIGS. 8 and 9.

The first and second shift registers 210 and 220 may operate as an edge-triggered latch or a level-triggered latch according to the first or second pulse width control signal EDC1 or EDC2.

Figure 8:
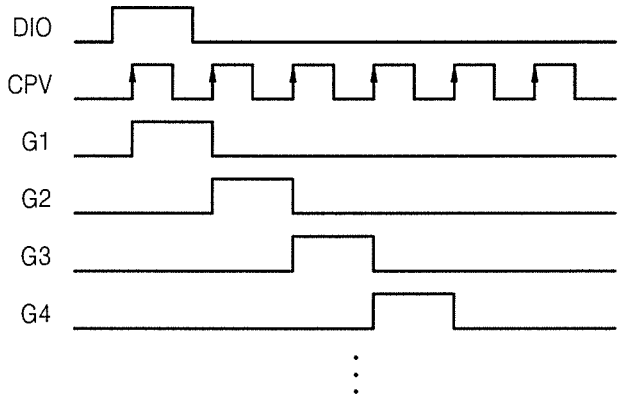
FIG. 8 is a timing diagram for describing an edge-triggered latch operation.

FIG. 8 is a timing diagram for describing an edge-triggered latch operation. As shown in FIG. 8, when the first or second shift register 210 or 220 operates as an edge-triggered latch, the first or second shift register 210 or 220 synchronizes with a rising or falling edge while a frame start pulse DIO is activated, thereby outputting the first through fourth gate driving signals G1 through G4. In FIG. 8, the first or second shift register 210 or 220 is edge-triggered by being synchronized with the rising edge. When the first or second shift register 210 or 220 operates as the edge-triggered latch by synchronizing with the rising edge, a pulse width of each of the first through fourth gate driving signals G1 through G4 is determined by a number of periods of a clock signal CPV within a width of the frame start pulse DIO.

Figure 9:
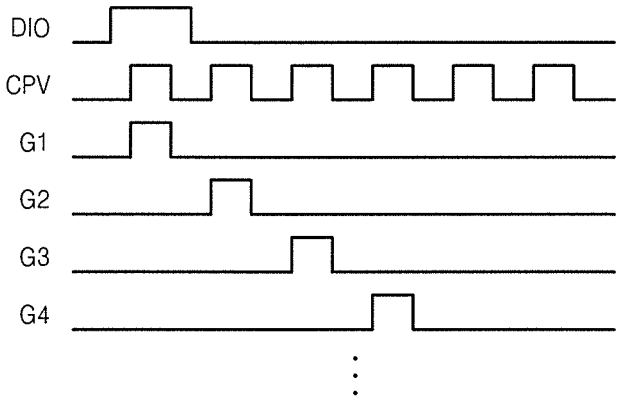
FIG. 9 is a timing diagram for describing a level-triggered latch operation.

FIG. 9 is a timing diagram for describing a level-triggered latch operation. As shown in FIG. 9, when the first or second shift register 210 or 220 operates as a level-triggered latch, the output of the first or second shift register 210 or 220 synchronizes with the same level as the pulse width of the clock signal CPV while the frame start pulse DIO is activated, thereby outputting the first through fourth gate driving signals G1 through G4.

In embodiments of the present invention, an edge-triggered latch function and a level-triggered latch function are selectively activated by using the first and second pulse width control signals EDC1 and EDC2. For example, the first and second pulse width control signals EDC1 and EDC2 are deactivated to use the first and second shift registers 210 and 220 as level-triggered latches, and the first and second pulse width control signals EDC1 and EDC2 are activated to use the first and second shift registers 210 and 220 as edge-triggered latches. Specifically, according to embodiments of the present invention, the first and second shift registers 210 and 220 are used as the edge-triggered latches to adjust the pulse widths of the gate driving signals G1 through Gn. Referring back to FIG. 7, operations of the light emission control signal and controlling of a pulse width will be described in more detail.

In FIG. 7, the second group gate driving signals G2 and G4 are used as the light emission control signals, and the second shift register 220 and the second inverter 240 are used to generate the light emission control signals. Since a timing of the light emission control signal is controlled when the light emission control signal is deactivated, i.e., when the light-emitting device does not emit light, the second inversion control signal INV2 is deactivated so as to control a period when the light emission control signal is deactivated, e.g., when the light emission control signal is in a high level. Also, in order to use the second shift register 220 as an edge-triggered latch, the second pulse width control signal EDC2 is activated to, e.g., a high level. A pulse width is determined by a width of a period when the second frame start pulse is activated. In FIG. 7, the second frame start pulse is activated during a period T3, and a pulse width T4 of the second gate driving signal G2 and a pulse width T5 of the fourth gate driving signal G4 are determined based on a pulse width of the second frame start pulse. In other words, during the period T3 when the second frame start pulse is activated, the second gate driving signal G2 is activated to a high level by being synchronized with the rising edge of the third clock signal CPV3 in operation C3, and a pulse width of a high level of the second gate driving signal G2 has a width T4 determined by the number of periods of the third clock signal CPV3 within the period T3 when the second frame start pulse is activated.

During the period T3 when the second frame start pulse is activated, the fourth gate driving signal G4 is activated to a high level by being synchronized with the rising edge of the fourth clock signal CPV4 in operation C4, and a pulse width of a high level of the fourth gate driving signal G4 has a width T5 determined by the number of periods of the fourth clock signal CPV4 within the period T3 when the second frame start pulse is activated.

In the embodiment of FIG. 7, the pulse width of the light emission control signal is adjusted, but a pulse width of the scanning signal may also be adjusted. The pulse width of the scanning signal may be adjusted for an overlap operation, or the like, and the embodiments of the present invention may provide a function of adjusting the pulse width of the scanning signal.

The function of concurrently (e.g., simultaneously) outputting gate driving signals from all output channels of a gate driving circuit will now be described.

In the light-emitting display apparatus 200 of an active matrix type, according to one embodiment, each of the pixels $P_{11}$ through $P_{nm}$ includes a storage capacitor, and a voltage corresponding to the data signal may be stored in the storage capacitors to drive the light-emitting devices of the pixels $P_{11}$ through $P_{nm}$. According to one embodiment, a displaying method of concurrently (e.g., simultaneously) emitting light by all pixels $P_{11}$ through $P_{nm}$ is disclosed herein. Accordingly, a voltage corresponding to each data signal is stored in the storage capacitors of the pixels $P_{11}$ through $P_{nm}$ and the light emission control signals for the pixels $P_{11}$ through $P_{nm}$ are concurrently (e.g., simultaneously) activated, thereby concurrently (e.g., simultaneously) emitting light by the pixels $P_{11}$ through $P_{nm}$. The above-described embodiment of the present invention provides the function of concurrent (e.g., simultaneous) light emission by all pixels $P_{11}$ through $P_{nm}$. For example, when the simultaneous light emission control signal ALL is deactivated, the gate driving signals G1 through Gn are sequentially output, and when the simultaneous light emission control signal ALL is activated, the gate driving signals G1 through Gn may be concurrently (e.g., simultaneously) activated and output. Also, the simultaneous light emission control signal ALL may operate according to a logic shown in Table 1 in association with the first and second pulse width control signals EDC1 and EDC2.

TABLE 1

| ALL | EDC1 | EDC2 | Operation |
|---|---|---|---|
| Deactivated | X | X | Sequential Output |
| Activated | Deactivated | Deactivated | Concurrent Output of All Gate Driving Signals |
| | Deactivated | Activated | Concurrent Output of Second Group Gate Driving Signals |
| | Activated | Deactivated | Concurrent Output of First Group Gate Driving Signals |
| | Activated | Activated | Concurrent Output of All Gate Driving Signals |

The logic may be realized. for example, by using a suitable logic circuit.

Figure 10:
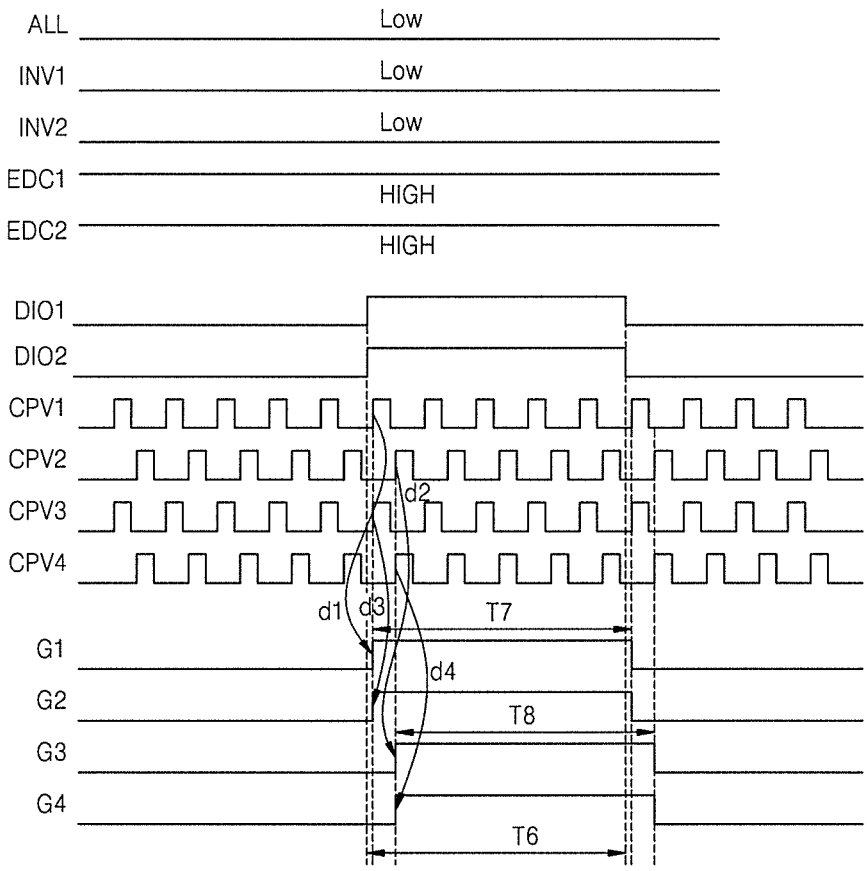
FIG. 10 is a timing diagram for describing a simultaneous light emitting operation according to an embodiment of the present invention.

FIG. 10 is a timing diagram for describing a concurrent (e.g., simultaneous) light emitting operation according to an embodiment of the present invention.

The simultaneous light emission control signal ALL is activated to, e.g., a low level for concurrent (e.g., simultaneous) light emission. Also, since the first and second pulse width control signals EDC1 and EDC2 are all activated to, e.g., high levels, all gate driving signals perform the concurrent (e.g., simultaneous) light emitting operation as shown in Table 1. Also, the first shift register 210 operates as an edge-triggered latch in response to the first and second clock signals CPV1 and CPV2, and generates and outputs the first and third gate driving signals G1 and G3, in operations d1 and d2. The second shift register 220 operates as an edge-triggered latch in response to the third and fourth clock signals CPV3 and CPV4, and generates and outputs the second and fourth gate driving signals G2 and G4, in operations d3 and d4. Pulse widths T7 of the first and second gate driving signals G1 and G2 and pulse widths T8 of the third and fourth gate driving signals G3 and G4 are determined by numbers of periods of the first and second clock signals CPV1 and CPV2, and the third and fourth clock signals CPV3 and CPV4 within the period T6 of the first and second frame start pulses respectively.

In the embodiments described above, the output channel selection signals SEL1 and SEL2, the first and second inversion control signals INV1 and INV2, and the first and second pulse width control signals EDC1 and EDC2 are described to have high levels when activated and low levels when deactivated, whereas the simultaneous light emission control signal ALL is described to have a high level when deactivated and a low level when activated. However, levels of such signals may be arbitrarily determined in some embodiments.

A gate driving circuit according to the embodiments of the present invention not only generates a gate driving signal for a light-emitting display apparatus having an N-type transistor in a pixel circuit, but also generates a gate driving signal for a light-emitting display apparatus having a P-type transistor in a pixel circuit.

Also, the gate driving circuit according to the embodiments of the present invention independently operates a first group gate driving signal and a second group gate driving signal by using control signals, and thus a scanning signal and a light emission control signal may be generated and output by a single gate driving circuit.

In addition, the gate driving circuit according to the embodiments of the present invention may adjust a pulse width of a gate driving signal.

Moreover, the gate driving circuit according to the embodiments of the present invention includes a function of controlling concurrent (e.g., simultaneous) light emission, thereby concurrently (e.g., simultaneously) emitting light by pixels of the light-emitting display apparatus.

While the present invention has been particularly shown and described with reference to exemplary embodiments thereof, it will be understood by those of ordinary skill in the art that various changes in form and details may be made therein without departing from the spirit and scope of the present invention as defined by the following claims, and equivalents thereof.

What is claimed is:

1. A gate driving circuit for driving a light-emitting display apparatus, the gate driving circuit comprising:

a first shift register for outputting a first shift register output in response to a first frame start pulse;

a second shift register for outputting a second shift register output in response to a second frame start pulse;

a first inverter for selectively inverting the first shift register output according to a first inversion control signal; and a second inverter for selectively inverting the second shift register output according to a second inversion control signal, wherein the first shift register and the second shift register independently operate, and the first inverter and the second inverter independently operate, and a first group gate driving signal is output through the first shift register and the first inverter, and a second group gate driving signal is output through the second shift register and the second inverter, wherein the first or second inversion control signal is activated or deactivated according to a transistor type of a pixel circuit, wherein the first or second shift register is configured to operate to be synchronized with a level of at least one corresponding first or second shift register clock signal, while the corresponding first or second frame start pulse is activated, according to a pulse width control of the first or second group gate driving signal, and wherein the first or second shift register is configured to operate to latch at a rising or a falling edge of the at least one corresponding first or second shift register clock signal, while the corresponding first or second frame start pulse is activated, according to the pulse width control of the first or second group gate driving signal.

2. The gate driving circuit of claim 1, further comprising:

a level shifter for adjusting voltage levels of an output of the first inverter and an output of the second inverter; and an output buffer for storing an output of the level shifter and outputting the output of the level shifter as the first and second group gate driving signals.

3. The gate driving circuit of claim 1, wherein the first shift register is configured to operate in response to at least one first shift register clock signal, and the second shift register is configured to operate in response to at least one second shift register clock signal.

4. The gate driving circuit of claim 1, wherein the first shift register is configured to adjust a pulse width of the first group gate driving signal in response to a first pulse width control signal, and the second shift register is configured to adjust a pulse width of the second group gate driving signal in response to a second pulse width control signal.

5. The gate driving circuit of claim 4, wherein the first shift register is configured to operate in response to at least one first shift register clock signal, the second shift register is configured to operate in response to at least one second shift register clock signal.

6. The gate driving circuit of claim 5, wherein, when a pulse width of the first group gate driving signal is adjusted, the first pulse width control signal is activated and the pulse width of the first group gate driving signal is determined by a pulse width of the first frame start pulse, and when a pulse width of the second group gate driving signal is adjusted, the second pulse width control signal is activated and the pulse width of the second group gate driving signal is determined by a pulse width of the second frame start pulse.

7. The gate driving circuit of claim 1, wherein the gate driving circuit is configured to select a number or combination of output channels to be activated from among output channels of the first and second group gate driving signals, according to an output channel selection signal.

8. The gate driving circuit of claim 1, wherein an output order of output channels of the first and second group gate driving signals is controlled according to a scanning direction control signal.

9. The gate driving circuit of claim 1, wherein the first and second group gate driving signals are sequentially output according to a simultaneous light emission control signal, and wherein the first and second group gate driving signals are concurrently output according to the simultaneous light emission control signal.

10. The gate driving circuit of claim 1, wherein, when the first or second group gate driving signal is a signal supplied to a pixel circuit realized with a P-type transistor, the corresponding first or second inversion control signal is activated, and the corresponding first or second shift register output is inverted and output from the corresponding first or second inverter.

11. The gate driving circuit of claim 1, wherein, when the first or second group gate driving signal is a signal supplied to a pixel circuit realized with an N-type transistor, the corresponding first or second inversion control signal is deactivated, and the corresponding first or second shift register output is transmitted as an output from the corresponding first or second inverter.

12. The gate driving circuit of claim 1, wherein the first group gate driving signal is a scanning signal, and the second group gate driving signal is a light emission control signal.

13. The gate driving circuit of claim 1, wherein the light-emitting display apparatus is an organic electroluminescent display apparatus.

14. An organic electroluminescent display apparatus comprising:

a plurality of pixels located at crossing regions of data lines and scanning lines, each of the pixels comprising an organic light-emitting diode (OLED);

a gate driver for outputting scanning signals through the scanning lines to each of the plurality of pixels, and for outputting a light emission control signal through light emission control lines; and a data driver for generating a data signal corresponding to an image and outputting the generated data signal to each of the plurality of pixels through the data lines, wherein the gate driver comprises the gate driving circuit according to claim 1.

* * * * *